US010285907B2

(12) United States Patent
David et al.

(10) Patent No.: US 10,285,907 B2
(45) Date of Patent: May 14, 2019

(54) DUAL VIAL ADAPTER ASSEMBLAGES WITH QUICK RELEASE DRUG VIAL ADAPTER FOR ENSURING CORRECT USAGE

(71) Applicant: MEDIMOP Medical Projects Ltd., Ra'anana (IL)

(72) Inventors: Uri David, Nes Ziona (IL); Mordechai Bukhman, Netanya (IL)

(73) Assignee: West Pharma. Services IL, Ltd., Ra'anana (IL)

( * ) Notice: Subject to any disclaimer, the term of this patent is extended or adjusted under 35 U.S.C. 154(b) by 0 days.

(21) Appl. No.: 15/541,242

(22) PCT Filed: Jan. 3, 2016

(86) PCT No.: PCT/IL2016/050002
§ 371 (c)(1),
(2) Date: Jun. 30, 2017

(87) PCT Pub. No.: WO2016/110838
PCT Pub. Date: Jul. 14, 2016

(65) Prior Publication Data

US 2017/0354571 A1 Dec. 14, 2017

(30) Foreign Application Priority Data

Jan. 5, 2015 (IL) ..... 236586

(51) Int. Cl.
*A61J 1/20* (2006.01)

(52) U.S. Cl.
CPC ..... *A61J 1/2089* (2013.01); *A61J 1/201* (2015.05); *A61J 1/2013* (2015.05); *A61J 1/2055* (2015.05)

(58) Field of Classification Search
CPC ..... A61J 1/2089; A61J 1/201; A61J 1/2013; A61J 1/2055
See application file for complete search history.

(56) References Cited

U.S. PATENT DOCUMENTS 62,333 A 2/1867 Holl
247,975 A 10/1881 Wickes
(Continued)

FOREIGN PATENT DOCUMENTS

CN 1636605 A 7/2005
CN 1747683 A 3/2006
(Continued)

OTHER PUBLICATIONS

Grifols Vial Adapter Product Literature, 2 pages, Jan. 2002. cited by other.

(Continued)

*Primary Examiner* — Kai H Weng
(74) *Attorney, Agent, or Firm* — Panitch Schwarze Belisario & Nadel LLP

(57) ABSTRACT

Dual vial adapter assemblages similar to U.S. Pat. No. 6,558,365 to Zinger et al. and U.S. Pat. No. 8,752,598 to Denenburg et al. and including a quick release drug vial adapter with an upright finger grip extension pair oppositely for manually urging inwards towards one another for releasing same from a drug vial. The quick release drug vial adapter ensures correct usage of a dual vial adapter assemblage by preventing immediate removal of a drug vial adapter from a drug vial after forming a liquid drug therein thereby assisting a healthcare provider to follow an administration protocol requiring an initial aspiration of some liquid drug for immediate administration purposes to a patient prior to subsequent infusion of the liquid drug remainder.

3 Claims, 9 Drawing Sheets

(56) References Cited

U.S. PATENT DOCUMENTS

| | | | |
|---|---|---|---|
| 254,444 | A | 2/1882 | Vogel |
| 300,060 | A | 6/1884 | Ford |
| 1,021,681 | A | 3/1912 | Jennings |
| 1,704,817 | A | 3/1929 | Ayers |
| 1,930,944 | A | 10/1933 | Schmitz, Jr. |
| 2,326,490 | A | 8/1943 | Perelson |
| 2,560,162 | A | 7/1951 | Garwood |
| 2,748,769 | A | 6/1956 | Huber |
| 2,830,587 | A | 4/1958 | Everett |
| 2,931,668 | A | 4/1960 | Baley |
| 2,968,497 | A | 1/1961 | Treleman |
| 3,059,643 | A | 10/1962 | Barton |
| D198,499 | S | 6/1964 | Harautuneian |
| 3,225,763 | A | 12/1965 | Waterman |
| 3,277,893 | A | 10/1966 | Clark |
| 3,308,822 | A | 3/1967 | De Luca |
| 3,484,849 | A | 12/1969 | Huebner et al. |
| 3,618,637 | A | 11/1971 | Santomieri |
| 3,757,981 | A | 9/1973 | Harris, Sr. et al. |
| 3,782,365 | A | 1/1974 | Pinna |
| 3,788,524 | A | 1/1974 | Davis et al. |
| 3,822,700 | A | 7/1974 | Pennington |
| 3,826,261 | A | 7/1974 | Killinger |
| 3,872,992 | A | 3/1975 | Larson |
| 3,885,607 | A | 5/1975 | Peltier |
| 3,938,520 | A | 2/1976 | Scislowicz et al. |
| 3,957,052 | A | 5/1976 | Topham |
| 3,977,555 | A | 8/1976 | Larson |
| 3,993,063 | A | 11/1976 | Larrabee |
| 4,020,839 | A | 5/1977 | Klapp |
| 4,026,128 | A | 5/1977 | Blanco |
| 4,051,852 | A | 10/1977 | Villari |
| D247,975 | S | 5/1978 | Luther |
| D248,568 | S | 7/1978 | Ismach |
| 4,109,670 | A | 8/1978 | Slagel |
| 4,121,585 | A | 10/1978 | Becker, Jr. |
| 4,161,178 | A | 7/1979 | Genese |
| 4,187,848 | A | 2/1980 | Taylor |
| D254,444 | S | 3/1980 | Levine |
| 4,203,067 | A | 5/1980 | Fitzky et al. |
| 4,203,443 | A | 5/1980 | Genese |
| 4,210,173 | A | 7/1980 | Choksi et al. |
| D257,286 | S | 10/1980 | Folkman |
| 4,253,501 | A | 3/1981 | Ogle |
| 4,296,786 | A | 10/1981 | Brignola |
| 4,303,067 | A | 12/1981 | Connolly et al. |
| 4,312,349 | A | 1/1982 | Cohen |
| 4,314,586 | A | 2/1982 | Folkman |
| 4,328,802 | A | 5/1982 | Curley et al. |
| 4,335,717 | A | 6/1982 | Bujan et al. |
| D267,199 | S | 12/1982 | Koenig |
| 4,376,634 | A | 3/1983 | Prior et al. |
| D268,871 | S | 5/1983 | Benham et al. |
| 4,392,850 | A | 7/1983 | Elias et al. |
| D270,282 | S | 8/1983 | Gross |
| 4,410,321 | A | 10/1983 | Pearson et al. |
| 4,411,662 | A | 10/1983 | Pearson |
| D271,421 | S | 11/1983 | Fetterman |
| 4,434,823 | A | 3/1984 | Kludspith |
| 4,465,471 | A | 8/1984 | Harris et al. |
| 4,475,915 | A | 10/1984 | Sloane |
| 4,493,348 | A | 1/1985 | Lemmons |
| 4,505,709 | A | 3/1985 | Froning et al. |
| 4,507,113 | A | 3/1985 | Dunlap |
| D280,018 | S | 8/1985 | Scott |
| 4,532,969 | A | 8/1985 | Kwaan |
| 4,564,054 | A | 1/1986 | Gustaysson |
| 4,573,993 | A | 3/1986 | Hoag et al. |
| 4,576,211 | A | 3/1986 | Valentini et al. |
| 4,581,014 | A | 4/1986 | Millerd et al. |
| 4,585,446 | A | 4/1986 | Kempf |
| 4,588,396 | A | 5/1986 | Stroebel et al. |
| 4,588,403 | A | 5/1986 | Weiss et al. |
| D284,603 | S | 7/1986 | Loignon |
| 4,604,093 | A | 8/1986 | Brown et al. |
| 4,607,671 | A | 8/1986 | Aalto et al. |
| 4,614,437 | A | 9/1986 | Buehler |
| 4,638,975 | A | 1/1987 | Iuchi et al. |
| 4,639,019 | A | 1/1987 | Mittleman |
| 4,667,927 | A | 5/1987 | Oscarsson |
| 4,675,020 | A | 6/1987 | McPhee |
| 4,676,530 | A | 6/1987 | Nordgren et al. |
| 4,683,975 | A | 8/1987 | Booth et al. |
| 4,697,622 | A | 10/1987 | Swift et al. |
| 4,721,133 | A | 1/1988 | Sundblom |
| 4,729,401 | A | 3/1988 | Raines |
| 4,735,608 | A | 4/1988 | Sardam |
| 4,743,229 | A | 5/1988 | Chu |
| 4,743,243 | A | 5/1988 | Vaillancourt |
| 4,752,292 | A | 6/1988 | Lopez et al. |
| 4,758,235 | A | 7/1988 | Tu |
| 4,759,756 | A | 7/1988 | Forman et al. |
| 4,778,447 | A | 10/1988 | Velde et al. |
| 4,787,898 | A | 11/1988 | Raines |
| 4,797,898 | A | 1/1989 | Martinez |
| D300,060 | S | 2/1989 | Molgaard-Nielsen |
| 4,804,366 | A | 2/1989 | Zdeb et al. |
| 4,826,492 | A | 5/1989 | Magasi |
| 4,832,690 | A | 5/1989 | Kuu |
| 4,834,152 | A | 5/1989 | Howson et al. |
| D303,013 | S | 8/1989 | Konopka |
| 4,857,062 | A | 8/1989 | Russell |
| 4,865,592 | A | 9/1989 | Rycroft |
| 4,871,463 | A | 10/1989 | Taylor et al. |
| 4,898,209 | A | 2/1990 | Zbed |
| 4,909,290 | A | 3/1990 | Coccia |
| 4,919,596 | A | 4/1990 | Slate et al. |
| 4,927,423 | A | 5/1990 | Malmborg |
| 4,931,040 | A | 6/1990 | Haber et al. |
| 4,932,944 | A | 6/1990 | Jagger et al. |
| 4,967,797 | A | 11/1990 | Manska |
| D314,050 | S | 1/1991 | Sone |
| D314,622 | S | 2/1991 | Andersson et al. |
| 4,997,430 | A | 3/1991 | Van der Heiden et al. |
| 5,006,114 | A | 4/1991 | Rogers et al. |
| 5,035,686 | A | 7/1991 | Crittenden et al. |
| 5,041,105 | A | 8/1991 | D'Alo et al. |
| 5,045,066 | A | 9/1991 | Scheuble et al. |
| 5,049,129 | A | 9/1991 | Zdeb et al. |
| 5,053,015 | A | 10/1991 | Gross |
| 5,061,248 | A | 10/1991 | Sacco |
| 5,088,996 | A | 2/1992 | Kopfer et al. |
| 5,096,575 | A | 3/1992 | Cosack |
| 5,104,387 | A | 4/1992 | Pokorney et al. |
| 5,113,904 | A | 5/1992 | Aslanian |
| 5,122,124 | A | 6/1992 | Novacek et al. |
| 5,125,908 | A | 6/1992 | Cohen |
| 5,125,915 | A | 6/1992 | Berry et al. |
| D328,788 | S | 8/1992 | Sagae et al. |
| 5,171,230 | A | 12/1992 | Eland et al. |
| 5,201,705 | A | 4/1993 | Berglund et al. |
| 5,201,717 | A | 4/1993 | Wyatt et al. |
| 5,203,771 | A | 4/1993 | Melker et al. |
| 5,203,775 | A | 4/1993 | Frank et al. |
| 5,211,638 | A | 5/1993 | Dudar et al. |
| 5,232,029 | A | 8/1993 | Knox et al. |
| 5,232,109 | A | 8/1993 | Tirrell et al. |
| 5,242,432 | A | 9/1993 | DeFrank |
| 5,247,972 | A | 9/1993 | Tetreault |
| D341,420 | S | 11/1993 | Conn |
| 5,269,768 | A | 12/1993 | Cheung |
| 5,270,219 | A | 12/1993 | DeCastro et al. |
| 5,279,576 | A | 1/1994 | Loo et al. |
| 5,288,290 | A | 2/1994 | Brody |
| 5,300,034 | A | 4/1994 | Behnke et al. |
| 5,301,685 | A | 4/1994 | Guirguis |
| 5,304,163 | A | 4/1994 | Bonnici et al. |
| 5,304,165 | A | 4/1994 | Haber et al. |
| 5,308,483 | A | 5/1994 | Sklar et al. |
| 5,312,377 | A | 5/1994 | Dalton |
| 5,328,474 | A | 7/1994 | Raines |
| D349,648 | S | 8/1994 | Tirrell et al. |
| 5,334,163 | A | 8/1994 | Sinnett |
| 5,334,179 | A | 8/1994 | Poli et al. |

(56) References Cited

U.S. PATENT DOCUMENTS 5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.
D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan
6,113,583 A 9/2000 Fowles et al.
6,117,114 A 9/2000 Paradis
D431,864 S 10/2000 Jansen
6,139,534 A 10/2000 Niedospial, Jr. et al.
6,142,446 A 11/2000 Leinsing
6,146,362 A 11/2000 Turnbull et al.
6,149,623 A 11/2000 Reynolds
6,156,025 A 12/2000 Niedospial, Jr. et al.

(56) References Cited

U.S. PATENT DOCUMENTS

| | | | |
|---|---|---|---|
| 6,159,192 | A | 12/2000 | Fowles et al. |
| 6,168,037 | B1 | 1/2001 | Grimard |
| 6,171,287 | B1 | 1/2001 | Lynn et al. |
| 6,171,293 | B1 | 1/2001 | Rowley et al. |
| 6,173,852 | B1 | 1/2001 | Browne |
| 6,173,868 | B1 | 1/2001 | DeJonge |
| 6,174,304 | B1 | 1/2001 | Weston |
| 6,179,822 | B1 | 1/2001 | Niedospial, Jr. |
| 6,179,823 | B1 | 1/2001 | Niedospial, Jr. |
| 6,206,861 | B1 | 3/2001 | Mayer |
| 6,221,041 | B1 | 4/2001 | Russo |
| 6,221,054 | B1 | 4/2001 | Martin et al. |
| 6,221,065 | B1 | 4/2001 | Davis |
| 6,238,372 | B1 | 5/2001 | Zinger et al. |
| 6,245,044 | B1 | 6/2001 | Daw et al. |
| D445,501 | S | 7/2001 | Niedospial, Jr. |
| D445,895 | S | 7/2001 | Svendsen |
| 6,253,804 | B1 | 7/2001 | Safabash |
| 6,258,078 | B1 | 7/2001 | Thilly |
| 6,280,430 | B1 | 8/2001 | Neftel et al. |
| 6,290,688 | B1 | 9/2001 | Lopez et al. |
| 6,296,621 | B1 | 10/2001 | Masuda et al. |
| 6,299,131 | B1 | 10/2001 | Ryan |
| 6,343,629 | B1 | 2/2002 | Wessman et al. |
| 6,348,044 | B1 | 2/2002 | Coletti et al. |
| 6,358,236 | B1 | 3/2002 | DeFoggi et al. |
| 6,364,866 | B1 | 4/2002 | Furr et al. |
| 6,378,576 | B2 | 4/2002 | Thibault et al. |
| 6,378,714 | B1 | 4/2002 | Jansen et al. |
| 6,379,340 | B1 | 4/2002 | Zinger et al. |
| D457,954 | S | 5/2002 | Wallace et al. |
| 6,382,442 | B1 | 5/2002 | Thibault et al. |
| 6,386,397 | B2 | 5/2002 | Brotspies et al. |
| 6,408,897 | B1 | 6/2002 | Laurent et al. |
| 6,409,708 | B1 | 6/2002 | Wessman |
| 6,440,107 | B1 | 8/2002 | Trombley et al. |
| 6,453,949 | B1 | 9/2002 | Chau |
| 6,453,956 | B2 | 9/2002 | Safabash |
| 6,474,375 | B2 | 11/2002 | Spero et al. |
| 6,478,788 | B1 | 11/2002 | Aneas |
| D468,015 | S | 12/2002 | Horppu |
| 6,499,617 | B1 | 12/2002 | Niedospial, Jr. et al. |
| 6,503,240 | B1 | 1/2003 | Niedospial, Jr. et al. |
| 6,503,244 | B2 | 1/2003 | Hayman |
| 6,520,932 | B2 | 2/2003 | Taylor |
| 6,524,278 | B1 | 2/2003 | Campbell et al. |
| 6,524,295 | B2 | 2/2003 | Daubert et al. |
| D472,316 | S | 3/2003 | Douglas et al. |
| 6,530,903 | B2 | 3/2003 | Wang et al. |
| 6,537,263 | B1 | 3/2003 | Aneas |
| D472,630 | S | 4/2003 | Douglas et al. |
| 6,544,246 | B1 | 4/2003 | Niedospial, Jr. |
| 6,551,299 | B2 | 4/2003 | Miyoshi et al. |
| 6,558,365 | B2 | 5/2003 | Zinger et al. |
| 6,571,837 | B2 | 6/2003 | Jansen et al. |
| 6,572,591 | B2 | 6/2003 | Mayer |
| 6,575,955 | B2 | 6/2003 | Azzolini |
| 6,581,593 | B1 | 6/2003 | Rubin et al. |
| 6,582,415 | B1 | 6/2003 | Fowles et al. |
| D476,731 | S | 7/2003 | Cise et al. |
| 6,591,876 | B2 | 7/2003 | Safabash |
| 6,599,273 | B1 | 7/2003 | Lopez |
| 6,601,721 | B2 | 8/2003 | Jansen et al. |
| 6,626,309 | B1 | 9/2003 | Jansen et al. |
| 6,632,201 | B1 | 10/2003 | Mathias et al. |
| 6,638,244 | B1 | 10/2003 | Reynolds |
| D482,121 | S | 11/2003 | Harding et al. |
| D482,447 | S | 11/2003 | Harding et al. |
| 6,651,956 | B2 | 11/2003 | Miller |
| 6,652,509 | B1 | 11/2003 | Helgren et al. |
| D483,487 | S | 12/2003 | Harding et al. |
| D483,869 | S | 12/2003 | Tran et al. |
| 6,656,433 | B2 | 12/2003 | Sasso |
| 6,666,852 | B2 | 12/2003 | Niedospial, Jr. |
| 6,681,810 | B2 | 1/2004 | Weston |
| 6,681,946 | B1 | 1/2004 | Jansen et al. |
| 6,682,509 | B2 | 1/2004 | Lopez |
| 6,692,478 | B1 | 2/2004 | Paradis |
| 6,692,829 | B2 | 2/2004 | Stubler et al. |
| 6,695,829 | B2 | 2/2004 | Hellstrom et al. |
| 6,699,229 | B2 | 3/2004 | Zinger et al. |
| 6,706,022 | B1 | 3/2004 | Leinsing et al. |
| 6,706,031 | B2 | 3/2004 | Manera |
| 6,715,520 | B2 | 4/2004 | Andreasson et al. |
| 6,729,370 | B2 | 5/2004 | Norton et al. |
| 6,736,798 | B2 | 5/2004 | Ohkubo et al. |
| 6,745,998 | B2 | 6/2004 | Doyle |
| 6,746,438 | B1 | 6/2004 | Amissolle |
| 6,752,180 | B2 | 6/2004 | Delay |
| D495,416 | S | 8/2004 | Dimeo et al. |
| D496,457 | S | 9/2004 | Prais et al. |
| 6,802,490 | B2 | 10/2004 | Leinsing et al. |
| 6,832,994 | B2 | 12/2004 | Niedospial, Jr. et al. |
| 6,852,103 | B2 | 2/2005 | Fowles et al. |
| 6,875,203 | B1 | 4/2005 | Fowles et al. |
| 6,875,205 | B2 | 4/2005 | Leinsing |
| 6,878,131 | B2 | 4/2005 | Novacek et al. |
| 6,884,253 | B1 | 4/2005 | McFarlane |
| 6,890,328 | B2 | 5/2005 | Fowles et al. |
| D506,256 | S | 6/2005 | Miyoshi et al. |
| 6,901,975 | B2 | 6/2005 | Aramata et al. |
| 6,945,417 | B2 | 9/2005 | Jansen et al. |
| 6,948,522 | B2 | 9/2005 | Newbrough et al. |
| 6,949,086 | B2 | 9/2005 | Ferguson et al. |
| 6,951,613 | B2 | 10/2005 | Reif et al. |
| 6,957,745 | B2 | 10/2005 | Thibault et al. |
| 6,960,164 | B2 | 11/2005 | O'Heeron |
| 6,972,002 | B2 | 12/2005 | Thorne |
| 6,979,318 | B1 | 12/2005 | McDonald et al. |
| RE38,996 | E | 2/2006 | Crawford et al. |
| 6,994,315 | B2 | 2/2006 | Ryan et al. |
| 6,997,916 | B2 | 2/2006 | Simas, Jr. et al. |
| 6,997,917 | B2 | 2/2006 | Niedospial, Jr. et al. |
| 7,024,968 | B2 | 4/2006 | Raudabough et al. |
| 7,070,589 | B2 | 7/2006 | Lolachi et al. |
| 7,074,216 | B2 | 7/2006 | Fowles et al. |
| 7,083,600 | B2 | 8/2006 | Meloul |
| 7,086,431 | B2 | 8/2006 | D'Antonio et al. |
| 7,097,637 | B2 | 8/2006 | Triplett et al. |
| 7,100,890 | B2 | 9/2006 | Cote, Sr. et al. |
| 7,140,401 | B2 | 11/2006 | Wilcox et al. |
| 7,150,735 | B2 | 12/2006 | Hickle |
| 7,192,423 | B2 | 3/2007 | Wong |
| 7,195,623 | B2 | 3/2007 | Burroughs et al. |
| 7,241,285 | B1 | 7/2007 | Dikeman |
| 7,294,122 | B2 | 11/2007 | Kubo et al. |
| 7,306,199 | B2 | 12/2007 | Leinsing et al. |
| D561,348 | S | 2/2008 | Zinger et al. |
| 7,326,188 | B1 | 2/2008 | Russell et al. |
| 7,326,194 | B2 | 2/2008 | Zinger et al. |
| 7,350,764 | B2 | 4/2008 | Raybuck |
| 7,354,422 | B2 | 4/2008 | Riesenberger et al. |
| 7,354,427 | B2 | 4/2008 | Fangrow |
| 7,425,209 | B2 | 9/2008 | Fowles et al. |
| 7,435,246 | B2 | 10/2008 | Zihlmann |
| D580,558 | S | 11/2008 | Shigesada et al. |
| 7,452,348 | B2 | 11/2008 | Hasegawa |
| 7,470,257 | B2 | 12/2008 | Norton et al. |
| 7,470,265 | B2 | 12/2008 | Brugger et al. |
| 7,472,932 | B2 | 1/2009 | Weber et al. |
| 7,488,297 | B2 | 2/2009 | Flaherty |
| 7,491,197 | B2 | 2/2009 | Jansen et al. |
| 7,497,848 | B2 | 3/2009 | Leinsing et al. |
| 7,523,967 | B2 | 4/2009 | Steppe |
| 7,530,546 | B2 | 5/2009 | Ryan et al. |
| D595,420 | S | 6/2009 | Suzuki et al. |
| D595,421 | S | 6/2009 | Suzuki et al. |
| 7,540,863 | B2 | 6/2009 | Haindl |
| 7,540,865 | B2 | 6/2009 | Griffin et al. |
| 7,544,191 | B2 | 6/2009 | Peluso et al. |
| D595,862 | S | 7/2009 | Suzuki et al. |
| D595,863 | S | 7/2009 | Suzuki et al. |
| 7,611,487 | B2 | 11/2009 | Woehr et al. |
| 7,611,502 | B2 | 11/2009 | Daly |

(56) References Cited

U.S. PATENT DOCUMENTS

| | | | |
|---|---|---|---|
| 7,615,041 | B2 | 11/2009 | Sullivan et al. |
| 7,628,779 | B2 | 12/2009 | Aneas |
| 7,632,261 | B2 | 12/2009 | Zinger et al. |
| D608,900 | S | 1/2010 | Giraud et al. |
| 7,654,995 | B2 | 2/2010 | Marren et al. |
| 7,670,326 | B2 | 3/2010 | Shemesh |
| 7,695,445 | B2 | 4/2010 | Yuki |
| 7,704,229 | B2 | 4/2010 | Moberg et al. |
| D616,090 | S | 5/2010 | Kawamura |
| 7,713,247 | B2 | 5/2010 | Lopez |
| 7,717,886 | B2 | 5/2010 | Lopez |
| 7,722,090 | B2 | 5/2010 | Burton et al. |
| D616,984 | S | 6/2010 | Gilboa |
| 7,731,678 | B2 | 6/2010 | Tennican et al. |
| 7,743,799 | B2 | 6/2010 | Mosler et al. |
| 7,744,581 | B2 | 6/2010 | Wallen et al. |
| 7,757,901 | B2 | 7/2010 | Welp |
| 7,758,082 | B2 | 7/2010 | Weigel et al. |
| 7,758,560 | B2 | 7/2010 | Connell et al. |
| 7,762,524 | B2 | 7/2010 | Cawthon et al. |
| 7,766,304 | B2 | 8/2010 | Phillips |
| 7,771,383 | B2 | 8/2010 | Truitt et al. |
| D624,641 | S | 9/2010 | Boclet |
| 7,799,009 | B2 | 9/2010 | Niedospial, Jr. et al. |
| 7,803,140 | B2 | 9/2010 | Fangrow, Jr. |
| D627,216 | S | 11/2010 | Fulginiti |
| D630,732 | S | 1/2011 | Lev et al. |
| 7,862,537 | B2 | 1/2011 | Zinger et al. |
| 7,867,215 | B2 | 1/2011 | Akerlund et al. |
| 7,879,018 | B2 | 2/2011 | Zinger et al. |
| 7,895,216 | B2 | 2/2011 | Longshaw et al. |
| D634,007 | S | 3/2011 | Zinger et al. |
| 7,900,659 | B2 | 3/2011 | Whitley et al. |
| D637,713 | S | 5/2011 | Nord et al. |
| D641,080 | S | 7/2011 | Zinger et al. |
| 7,985,216 | B2 | 7/2011 | Daily et al. |
| D644,104 | S | 8/2011 | Maeda et al. |
| 7,993,328 | B2 | 8/2011 | Whitley |
| 8,007,461 | B2 | 8/2011 | Huo et al. |
| 8,012,132 | B2 | 9/2011 | Lum et al. |
| 8,016,809 | B2 | 9/2011 | Zinger et al. |
| 8,021,325 | B2 | 9/2011 | Zinger et al. |
| 8,025,653 | B2 | 9/2011 | Capitaine et al. |
| 8,025,683 | B2 | 9/2011 | Morrison |
| 8,029,472 | B2 | 10/2011 | Leinsing et al. |
| 8,038,123 | B2 | 10/2011 | Ruschke et al. |
| 8,066,688 | B2 | 11/2011 | Zinger et al. |
| 8,070,739 | B2 | 12/2011 | Zinger et al. |
| 8,075,550 | B2 | 12/2011 | Nord et al. |
| 8,096,525 | B2 | 1/2012 | Ryan |
| 8,105,314 | B2 | 1/2012 | Fangrow, Jr. |
| D654,166 | S | 2/2012 | Lair |
| D655,017 | S | 2/2012 | Mosler et al. |
| 8,122,923 | B2 | 2/2012 | Kraus et al. |
| 8,123,736 | B2 | 2/2012 | Kraushaar et al. |
| D655,071 | S | 3/2012 | Davila |
| D657,461 | S | 4/2012 | Schembre et al. |
| 8,152,779 | B2 | 4/2012 | Cabiri |
| 8,157,784 | B2 | 4/2012 | Rogers |
| 8,167,863 | B2 | 5/2012 | Yow |
| 8,172,824 | B2 | 5/2012 | Pfeifer et al. |
| 8,177,768 | B2 | 5/2012 | Leinsing |
| 8,182,452 | B2 | 5/2012 | Mansour et al. |
| 8,187,248 | B2 | 5/2012 | Zihlmann |
| 8,196,614 | B2 | 6/2012 | Kriheli |
| 8,197,459 | B2 | 6/2012 | Jansen et al. |
| 8,211,069 | B2 | 7/2012 | Fangrow, Jr. |
| 8,225,959 | B2 | 7/2012 | Lambrecht |
| 8,241,268 | B2 | 8/2012 | Whitley |
| 8,262,628 | B2 | 9/2012 | Fangrow, Jr. |
| 8,262,641 | B2 | 9/2012 | Vedrine et al. |
| 8,267,127 | B2 | 9/2012 | Kriheli |
| D669,980 | S | 10/2012 | Lev et al. |
| 8,287,513 | B2 | 10/2012 | Ellstrom et al. |
| 8,328,784 | B2 | 12/2012 | Jensen et al. |
| D673,673 | S | 1/2013 | Wang |
| D674,084 | S | 1/2013 | Linnenschmidt |
| D674,088 | S | 1/2013 | Lev et al. |
| 8,348,898 | B2 | 1/2013 | Cabiri |
| D681,230 | S | 4/2013 | Mosier et al. |
| 8,454,573 | B2 | 6/2013 | Wyatt et al. |
| 8,469,939 | B2 | 6/2013 | Fangrow, Jr. |
| 8,475,404 | B2 | 7/2013 | Foshee et al. |
| 8,480,645 | B1 | 7/2013 | Choudhury et al. |
| 8,480,646 | B2 | 7/2013 | Nord et al. |
| 8,506,548 | B2 | 8/2013 | Okiyama |
| 8,511,352 | B2 | 8/2013 | Kraus et al. |
| 8,512,309 | B2 | 8/2013 | Shemesh et al. |
| D690,009 | S | 9/2013 | Schembre et al. |
| D690,418 | S | 9/2013 | Rosenquist |
| 8,523,837 | B2 | 9/2013 | Wiggins et al. |
| 8,545,476 | B2 | 10/2013 | Ariagno et al. |
| 8,551,067 | B2 | 10/2013 | Zinger et al. |
| 8,556,879 | B2 | 10/2013 | Okiyama |
| 8,562,582 | B2 | 10/2013 | Tuckwell et al. |
| 8,608,723 | B2 | 12/2013 | Lev et al. |
| 8,628,508 | B2 | 1/2014 | Weitzel et al. |
| 8,684,992 | B2 | 4/2014 | Sullivan et al. |
| 8,684,994 | B2 | 4/2014 | Lev et al. |
| 8,752,598 | B2 | 6/2014 | Denenburg et al. |
| D714,935 | S | 10/2014 | Nishioka et al. |
| D717,406 | S | 11/2014 | Stanley et al. |
| D717,948 | S | 11/2014 | Strong et al. |
| D719,650 | S | 12/2014 | Arinobe et al. |
| D720,067 | S | 12/2014 | Rosenquist |
| D720,451 | S | 12/2014 | Denenburg et al. |
| D720,452 | S | 12/2014 | Jordan |
| 8,900,212 | B2 | 12/2014 | Kubo |
| 8,905,994 | B1 | 12/2014 | Lev et al. |
| 8,915,882 | B2 | 12/2014 | Cabiri |
| D720,850 | S | 1/2015 | Hsia et al. |
| D732,660 | S | 6/2015 | Ohashi |
| D732,664 | S | 6/2015 | Woehr et al. |
| D733,291 | S | 6/2015 | Wang |
| D733,292 | S | 6/2015 | Rogers |
| D733,293 | S | 6/2015 | Rogers |
| 9,072,827 | B2 | 7/2015 | Cabiri |
| D738,494 | S | 9/2015 | Kashmirian |
| D741,457 | S | 10/2015 | Guest |
| 9,149,575 | B2 | 10/2015 | Cabiri |
| D750,235 | S | 2/2016 | Maurice |
| D757,933 | S | 5/2016 | Lev et al. |
| 9,393,365 | B2 | 7/2016 | Cabiri |
| 9,486,391 | B2 | 11/2016 | Shemesh |
| 9,492,610 | B2 | 11/2016 | Cabiri |
| 9,511,190 | B2 | 12/2016 | Cabiri |
| 9,522,234 | B2 | 12/2016 | Cabiri |
| D794,183 | S | 8/2017 | Lev et al. |
| 9,763,855 | B2 | 9/2017 | Fangrow |
| 2001/0000347 | A1 | 4/2001 | Hellstrom et al. |
| 2001/0025671 | A1 | 10/2001 | Safabash |
| 2001/0029360 | A1 | 10/2001 | Miyoshi et al. |
| 2001/0051793 | A1 | 12/2001 | Weston |
| 2002/0017328 | A1 | 2/2002 | Loo |
| 2002/0055711 | A1 | 5/2002 | Lavi et al. |
| 2002/0065488 | A1 | 5/2002 | Suzuki et al. |
| 2002/0066715 | A1 | 6/2002 | Niedospial |
| 2002/0087118 | A1 | 7/2002 | Reynolds et al. |
| 2002/0087141 | A1 | 7/2002 | Zinger et al. |
| 2002/0087144 | A1 | 7/2002 | Zinger et al. |
| 2002/0121496 | A1 | 9/2002 | Thiebault et al. |
| 2002/0123736 | A1 | 9/2002 | Fowles et al. |
| 2002/0127150 | A1 | 9/2002 | Sasso |
| 2002/0128628 | A1 | 9/2002 | Fathallah |
| 2002/0138045 | A1 | 9/2002 | Moen |
| 2002/0173752 | A1 | 11/2002 | Polzin |
| 2002/0193777 | A1 | 12/2002 | Aneas |
| 2003/0028156 | A1 | 2/2003 | Juliar |
| 2003/0036725 | A1 | 2/2003 | Lavi et al. |
| 2003/0068354 | A1 | 4/2003 | Reif et al. |
| 2003/0069550 | A1 | 4/2003 | Sharp |
| 2003/0073971 | A1 | 4/2003 | Saker |
| 2003/0100866 | A1 | 5/2003 | Reynolds |
| 2003/0109846 | A1 | 6/2003 | Zinger et al. |

(56) References Cited

U.S. PATENT DOCUMENTS

| | | | |
|---|---|---|---|
| 2003/0120209 | A1 | 6/2003 | Jensen et al. |
| 2003/0135159 | A1 | 7/2003 | Daily et al. |
| 2003/0153895 | A1 | 8/2003 | Leinsing |
| 2003/0187420 | A1 | 10/2003 | Akerlund et al. |
| 2003/0191445 | A1 | 10/2003 | Wallen et al. |
| 2003/0195479 | A1 | 10/2003 | Kuracina et al. |
| 2003/0199827 | A1 | 10/2003 | Thorne |
| 2003/0199846 | A1 | 10/2003 | Fowles et al. |
| 2003/0199847 | A1 | 10/2003 | Akerlund et al. |
| 2003/0205843 | A1 | 11/2003 | Adams |
| 2003/0236543 | A1 | 12/2003 | Brenneman et al. |
| 2004/0010207 | A1 | 1/2004 | Flaherty et al. |
| 2004/0024354 | A1 | 2/2004 | Reynolds |
| 2004/0039365 | A1 | 2/2004 | Aramata et al. |
| 2004/0044327 | A1 | 3/2004 | Hasegawa |
| 2004/0073189 | A1 | 4/2004 | Wyatt et al. |
| 2004/0143218 | A1 | 7/2004 | Das |
| 2004/0143226 | A1 | 7/2004 | Marsden |
| 2004/0153047 | A1 | 8/2004 | Blank et al. |
| 2004/0158172 | A1 | 8/2004 | Hancock |
| 2004/0162540 | A1 | 8/2004 | Walenciak et al. |
| 2004/0167472 | A1 | 8/2004 | Howell et al. |
| 2004/0181192 | A1 | 9/2004 | Cuppy |
| 2004/0186424 | A1 | 9/2004 | Hjertman |
| 2004/0199139 | A1 | 10/2004 | Fowles et al. |
| 2004/0204699 | A1 | 10/2004 | Hanly et al. |
| 2004/0217315 | A1 | 11/2004 | Doyle |
| 2004/0225274 | A1 | 11/2004 | Jansen et al. |
| 2004/0236305 | A1 | 11/2004 | Jansen et al. |
| 2004/0249341 | A1 | 12/2004 | Newbrough et al. |
| 2004/0255952 | A1 | 12/2004 | Carlsen et al. |
| 2005/0015070 | A1 | 1/2005 | Delnevo et al. |
| 2005/0016626 | A1 | 1/2005 | Wilcox et al. |
| 2005/0049553 | A1 | 3/2005 | Triplett et al. |
| 2005/0055008 | A1 | 3/2005 | Paradis et al. |
| 2005/0082828 | A1 | 4/2005 | Wicks et al. |
| 2005/0124964 | A1 | 6/2005 | Niedospial et al. |
| 2005/0137523 | A1 | 6/2005 | Wyatt et al. |
| 2005/0137566 | A1 | 6/2005 | Fowles et al. |
| 2005/0148994 | A1 | 7/2005 | Leinsing |
| 2005/0159706 | A1 | 7/2005 | Wilkinson et al. |
| 2005/0159724 | A1 | 7/2005 | Enerson |
| 2005/0182383 | A1 | 8/2005 | Wallen |
| 2005/0209554 | A1 | 9/2005 | Landau |
| 2005/0261637 | A1 | 11/2005 | Miller |
| 2005/0277896 | A1 | 12/2005 | Messerli et al. |
| 2006/0030832 | A1 | 2/2006 | Niedospial et al. |
| 2006/0079834 | A1 | 4/2006 | Tennican et al. |
| 2006/0089594 | A1 | 4/2006 | Landau |
| 2006/0089603 | A1 | 4/2006 | Truitt et al. |
| 2006/0095015 | A1 | 5/2006 | Hobbs et al. |
| 2006/0106360 | A1 | 5/2006 | Wong |
| 2006/0135948 | A1 | 6/2006 | Varma |
| 2006/0155257 | A1 | 7/2006 | Reynolds |
| 2006/0161192 | A1 | 7/2006 | Young |
| 2006/0173410 | A1 | 8/2006 | Moberg et al. |
| 2006/0178646 | A1 | 8/2006 | Harris et al. |
| 2006/0195029 | A1 | 8/2006 | Shults et al. |
| 2006/0212004 | A1 | 9/2006 | Atil |
| 2006/0253084 | A1 | 11/2006 | Nordgren |
| 2006/0259004 | A1 | 11/2006 | Connell et al. |
| 2007/0016381 | A1 | 1/2007 | Kamath et al. |
| 2007/0024995 | A1 | 2/2007 | Hayashi |
| 2007/0060904 | A1 | 3/2007 | Vedrine et al. |
| 2007/0078428 | A1 | 4/2007 | Reynolds et al. |
| 2007/0079894 | A1 | 4/2007 | Kraus et al. |
| 2007/0083164 | A1 | 4/2007 | Barrelle et al. |
| 2007/0088252 | A1 | 4/2007 | Pestotnik et al. |
| 2007/0088293 | A1 | 4/2007 | Fangrow |
| 2007/0088313 | A1 | 4/2007 | Zinger et al. |
| 2007/0106218 | A1 | 5/2007 | Yodfat et al. |
| 2007/0106244 | A1 | 5/2007 | Mosler et al. |
| 2007/0112324 | A1 | 5/2007 | Hamedi-Sangsari |
| 2007/0156112 | A1 | 7/2007 | Walsh |
| 2007/0167904 | A1 | 7/2007 | Zinger et al. |
| 2007/0167912 | A1 | 7/2007 | Causey et al. |
| 2007/0191760 | A1 | 8/2007 | Iguchi et al. |
| 2007/0191764 | A1 | 8/2007 | Zihlmann |
| 2007/0191767 | A1 | 8/2007 | Hennessy et al. |
| 2007/0203451 | A1 | 8/2007 | Murakami et al. |
| 2007/0219483 | A1 | 9/2007 | Kitani et al. |
| 2007/0244447 | A1 | 10/2007 | Capitaine et al. |
| 2007/0244461 | A1 | 10/2007 | Fangrow |
| 2007/0244462 | A1 | 10/2007 | Fangrow |
| 2007/0244463 | A1 | 10/2007 | Warren et al. |
| 2007/0249995 | A1 | 10/2007 | Van Manen |
| 2007/0255202 | A1 | 11/2007 | Kitani et al. |
| 2007/0265574 | A1 | 11/2007 | Tennican et al. |
| 2007/0265581 | A1 | 11/2007 | Funamura et al. |
| 2007/0270778 | A9 | 11/2007 | Zinger et al. |
| 2007/0287953 | A1 | 12/2007 | Ziv et al. |
| 2007/0299404 | A1 | 12/2007 | Katoh et al. |
| 2008/0009789 | A1 | 1/2008 | Zinger et al. |
| 2008/0009822 | A1 | 1/2008 | Enerson |
| 2008/0015496 | A1 | 1/2008 | Hamedi-Sangsari |
| 2008/0135051 | A1 | 6/2008 | Lee |
| 2008/0172024 | A1 | 7/2008 | Yow |
| 2008/0188799 | A1 | 8/2008 | Mueller-Beckhaus et al. |
| 2008/0195049 | A1 | 8/2008 | Thalmann et al. |
| 2008/0208138 | A1 | 8/2008 | Lim et al. |
| 2008/0215015 | A1 | 9/2008 | Cindrich et al. |
| 2008/0249473 | A1 | 10/2008 | Rutti et al. |
| 2008/0249479 | A1 | 10/2008 | Zinger et al. |
| 2008/0249498 | A1 | 10/2008 | Fangrow |
| 2008/0262465 | A1 | 10/2008 | Zinger et al. |
| 2008/0269687 | A1 | 10/2008 | Chong et al. |
| 2008/0275407 | A1 | 11/2008 | Scheurer |
| 2008/0287905 | A1 | 11/2008 | Hiejima et al. |
| 2008/0294100 | A1 | 11/2008 | de Costa et al. |
| 2008/0306439 | A1 | 12/2008 | Nelson et al. |
| 2008/0312634 | A1 | 12/2008 | Helmerson et al. |
| 2009/0012492 | A1 | 1/2009 | Zihlmann |
| 2009/0043253 | A1 | 2/2009 | Podaima |
| 2009/0054834 | A1 | 2/2009 | Zinger et al. |
| 2009/0054852 | A1 | 2/2009 | Takano et al. |
| 2009/0062767 | A1 | 3/2009 | Van Antwerp et al. |
| 2009/0076360 | A1 | 3/2009 | Brister et al. |
| 2009/0082750 | A1 | 3/2009 | Denenburg et al. |
| 2009/0139724 | A1 | 6/2009 | Gray et al. |
| 2009/0143758 | A1 | 6/2009 | Okiyama |
| 2009/0177177 | A1 | 7/2009 | Zinger et al. |
| 2009/0177178 | A1 | 7/2009 | Pedersen |
| 2009/0187140 | A1 | 7/2009 | Racz |
| 2009/0216103 | A1 | 8/2009 | Brister et al. |
| 2009/0216212 | A1 | 8/2009 | Fangrow, Jr. |
| 2009/0267011 | A1 | 10/2009 | Hatton et al. |
| 2009/0299325 | A1 | 12/2009 | Vedrine et al. |
| 2009/0318946 | A1 | 12/2009 | Tamesada |
| 2009/0326506 | A1 | 12/2009 | Hasegawa et al. |
| 2010/0010443 | A1 | 1/2010 | Morgan et al. |
| 2010/0016811 | A1 | 1/2010 | Smith |
| 2010/0022985 | A1 | 1/2010 | Sullivan et al. |
| 2010/0030181 | A1 | 2/2010 | Helle et al. |
| 2010/0036319 | A1 | 2/2010 | Drake et al. |
| 2010/0076397 | A1 | 3/2010 | Reed et al. |
| 2010/0087786 | A1 | 4/2010 | Zinger et al. |
| 2010/0137827 | A1 | 6/2010 | Warren et al. |
| 2010/0137831 | A1 | 6/2010 | Tsals |
| 2010/0152658 | A1 | 6/2010 | Hanson et al. |
| 2010/0160889 | A1 | 6/2010 | Smith et al. |
| 2010/0162548 | A1 | 7/2010 | Leidig |
| 2010/0168664 | A1 | 7/2010 | Zinger et al. |
| 2010/0168712 | A1 | 7/2010 | Tuckwell et al. |
| 2010/0179506 | A1 | 7/2010 | Shemesh et al. |
| 2010/0198148 | A1 | 8/2010 | Zinger et al. |
| 2010/0204670 | A1 | 8/2010 | Kraushaar et al. |
| 2010/0228220 | A1 | 9/2010 | Zinger et al. |
| 2010/0241088 | A1 | 9/2010 | Ranalletta et al. |
| 2010/0274184 | A1 | 10/2010 | Chun |
| 2010/0274202 | A1 | 10/2010 | Hyde et al. |
| 2010/0286661 | A1 | 11/2010 | Raday et al. |
| 2010/0312220 | A1 | 12/2010 | Kalitzki |
| 2011/0004143 | A1 | 1/2011 | Beiriger et al. |
| 2011/0004184 | A1 | 1/2011 | Proksch et al. |

(56) References Cited

U.S. PATENT DOCUMENTS

| | | | |
|---|---|---|---|
| 2011/0044850 | A1 | 2/2011 | Solomon et al. |
| 2011/0054440 | A1 | 3/2011 | Lewis |
| 2011/0087164 | A1 | 4/2011 | Mosler et al. |
| 2011/0125056 | A1 | 5/2011 | Merchant |
| 2011/0144584 | A1 | 6/2011 | Wozencroft |
| 2011/0160655 | A1 | 6/2011 | Hanson et al. |
| 2011/0160701 | A1 | 6/2011 | Wyatt et al. |
| 2011/0172636 | A1 | 7/2011 | Aasmul |
| 2011/0175347 | A1 | 7/2011 | Okiyama |
| 2011/0218511 | A1 | 9/2011 | Yokoyama |
| 2011/0224640 | A1 | 9/2011 | Kuhn et al. |
| 2011/0230856 | A1 | 9/2011 | Kyle et al. |
| 2011/0264037 | A1 | 10/2011 | Foshee et al. |
| 2011/0264069 | A1 | 10/2011 | Bochenko |
| 2011/0276007 | A1 | 11/2011 | Denenburg |
| 2011/0319827 | A1 | 12/2011 | Leinsing et al. |
| 2012/0022344 | A1 | 1/2012 | Kube |
| 2012/0022469 | A1 | 1/2012 | Alpert |
| 2012/0053555 | A1 | 3/2012 | Ariagno et al. |
| 2012/0059332 | A1 | 3/2012 | Woehr et al. |
| 2012/0059346 | A1 | 3/2012 | Sheppard et al. |
| 2012/0067429 | A1 | 3/2012 | Mosler et al. |
| 2012/0071819 | A1 | 3/2012 | Bruggemann et al. |
| 2012/0078214 | A1 | 3/2012 | Finke et al. |
| 2012/0123382 | A1 | 5/2012 | Kubo |
| 2012/0184938 | A1 | 7/2012 | Lev et al. |
| 2012/0215182 | A1 | 8/2012 | Mansour et al. |
| 2012/0220977 | A1 | 8/2012 | Yow |
| 2012/0220978 | A1 | 8/2012 | Lev et al. |
| 2012/0265163 | A1 | 10/2012 | Cheng et al. |
| 2012/0271229 | A1 | 10/2012 | Lev et al. |
| 2012/0296307 | A1 | 11/2012 | Holt et al. |
| 2012/0310203 | A1 | 12/2012 | Khaled et al. |
| 2012/0323172 | A1 | 12/2012 | Lev et al. |
| 2012/0323187 | A1 | 12/2012 | Iwase et al. |
| 2012/0323210 | A1 | 12/2012 | Lev et al. |
| 2013/0046269 | A1 | 2/2013 | Lev et al. |
| 2013/0053814 | A1 | 2/2013 | Mueller-Beckhaus et al. |
| 2013/0096493 | A1 | 4/2013 | Kubo et al. |
| 2013/0110049 | A1 | 5/2013 | Cronenberg et al. |
| 2013/0144248 | A1 | 6/2013 | Putter et al. |
| 2013/0199669 | A1 | 8/2013 | Moy et al. |
| 2013/0226100 | A1 | 8/2013 | Lev |
| 2013/0231630 | A1 | 9/2013 | Kraus et al. |
| 2013/0237904 | A1 | 9/2013 | Deneburg et al. |
| 2013/0253448 | A1 | 9/2013 | Baron et al. |
| 2013/0289530 | A1 | 10/2013 | Wyatt et al. |
| 2014/0020793 | A1 | 1/2014 | Denenburg et al. |
| 2014/0096862 | A1 | 4/2014 | Aneas |
| 2014/0150911 | A1 | 6/2014 | Hanner et al. |
| 2014/0194854 | A1 | 7/2014 | Tsals |
| 2014/0221940 | A1 | 8/2014 | Clauson et al. |
| 2014/0277052 | A1 | 9/2014 | Haselby et al. |
| 2014/0352845 | A1 | 12/2014 | Lev et al. |
| 2015/0082746 | A1 | 3/2015 | Ivosevic et al. |
| 2015/0088078 | A1 | 3/2015 | Lev et al. |
| 2015/0112297 | A1* | 4/2015 | Lev ..... A61J 1/2096 604/414 |
| 2015/0290390 | A1 | 10/2015 | Ring et al. |
| 2015/0305770 | A1 | 10/2015 | Fill et al. |
| 2016/0088995 | A1 | 3/2016 | Ueda et al. |
| 2016/0199569 | A1 | 7/2016 | Yevmenenko et al. |
| 2016/0228644 | A1 | 8/2016 | Cabiri |
| 2016/0287475 | A1 | 10/2016 | Yevmenenko et al. |

FOREIGN PATENT DOCUMENTS

| | | | |
|---|---|---|---|
| CN | 1863566 | A | 11/2006 |
| CN | 1950049 | A | 4/2007 |
| CN | 101001661 | A | 7/2007 |
| CN | 101687083 | A | 3/2010 |
| DE | 1064693 | B | 9/1959 |
| DE | 1913926 | A1 | 9/1970 |
| DE | 4122476 | A1 | 1/1993 |
| DE | 19504413 | A1 | 8/1996 |
| DE | 202004012714 | U1 | 11/2004 |
| DE | 202009011019 | U1 | 12/2010 |
| EP | 0192661 | A1 | 9/1986 |
| EP | 0195018 | A1 | 9/1986 |
| EP | 0258913 | A2 | 3/1988 |
| EP | 0416454 | A2 | 3/1991 |
| EP | 0282545 | B1 | 2/1992 |
| EP | 0518397 | A1 | 12/1992 |
| EP | 0521460 | A1 | 1/1993 |
| EP | 582038 | A2 | 2/1994 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887085 | A2 | 12/1998 |
| EP | 0887885 | A2 | 12/1998 |
| EP | 897708 | A2 | 2/1999 |
| EP | 0898951 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| EP | 2512399 | A1 | 10/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| JP | 03-062426 | B | 9/1991 |
| JP | 4329954 | A | 11/1992 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | A | 5/1998 |
| JP | H10-504736 | A | 5/1998 |
| JP | 11503627 | T | 3/1999 |
| JP | 11-319031 | A | 11/1999 |
| JP | 2000-508934 | A | 7/2000 |
| JP | 2000-237278 | A | 9/2000 |
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |
| JP | 2010-179128 | A | 8/2010 |
| JP | 2012-205769 | A | 10/2012 |
| JP | 2014000220 | A | 1/2014 |

(56) References Cited

FOREIGN PATENT DOCUMENTS

| | | | |
|---|---|---|---|
| WF | 0598918 | A1 | 6/1994 |
| WO | 8601712 | A1 | 3/1986 |
| WO | 8605683 | A1 | 10/1986 |
| WO | 9003536 | A1 | 4/1990 |
| WO | 9403373 | A1 | 2/1994 |
| WO | 9507066 | A1 | 3/1995 |
| WO | 9600053 | A1 | 1/1996 |
| WO | 9609083 | A1 | 3/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0189607 | A2 | 11/2001 |
| WO | 0191693 | A2 | 12/2001 |
| WO | 0202165 | A2 | 1/2002 |
| WO | 200209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2005002492 | A1 | 1/2005 |
| WO | 2005018703 | A2 | 3/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007101772 | A1 | 9/2007 |
| WO | 2007105221 | A1 | 9/2007 |
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011004360 | A1 | 1/2011 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012004784 | A1 | 1/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014174278 | A1 | 10/2014 |
| WO | 2016023590 | A1 | 2/2016 |

OTHER PUBLICATIONS

Novel Transfer, Mixing and Drug Delivery Systems, MOP Medimop Medical Projects Ltd. Catalog, 4 pages, Rev. 4, 2004. cited by other.

Smart Site.RTM. Alaris Medical Systems Product Brochure, 4 pages, Issue 1, Oct. 1999. cited by other.

Smart Site.RTM. Needle-Free Systems, Alaris Medical Systems Webpage, 4 pages, Feb. 2006. cited by other.

Photographs of Alaris Medical Systems SmartSite.RTM. device, 5 pages, 2002. cited by other.

Non-Vented Vial Access Pin with Ultrasite.RTM. Valve, B. Braun Medical, Inc. website and product description, 3 pages, Feb. 2006. cited by other.

http://www.westpharma.com/en/products/Pages/Mixject.aspx (admitted prior art).

http://www.westpharma.com/SiteCollectionDocuments/Recon/mixject%20product%20sheet.pdf; MIXJECT product information sheet pp. 1. (admitted prior art).

The MixJect transfer system, as shown in the article, "Advanced Delivery Devices," Drug Delivery Technology Jul./Aug. 2007 vol. 7 No. 7 [on-line]. [Retrieved from Internet May 14, 2010.] URL: <http://www.drugdeiverytech-online.com/drugdelivery/200707/?pg=28pg28>. (3 pages).

Publication date of Israeli Patent Application 186290 [on-line]. ]Retrieved from Internet May 24, 2010]. URL:<http://www.ilpatsearch.justrice.gov.il/Ul/RequestsList.aspx>. (1 page).

Overview—Silicone Rubber [retrieved from http://www.knovel.com/web/portal/browse/display?_EXT_KNOVEL_DISPLAY_bookid=1023&VerticallD=0 on Feb. 9, 2011].

Kipp, "Plastic Material Data Sheets," retrieved from the internet: http://www.knovel.com/web/portal/browse/display?_EXT_KNOVEL_DISPLAY_bookid=1023&VerticallD=0, retrieved on Feb. 9, 2011.

Alaris Medical Systems Product Brochure, 4 pages, Issue 1, Oct. 11, 1999.

Smart Site Needle-Free Systems, Alaris Medical Systems Webpage, 4 pages, Feb. 2006.

Photographs of Alaris Medical Systems SmartSite.RTM. device, 5 pages, 2002.

Non-Vented Vial Access Pin with Ultrasite.RTM. Valve, B. Braun Medical, Inc. website and product description, 3 pages, Feb. 2006.

IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).

Drug Administration Systems product information sheets; http://www.westpharma.com/eu/en/products/Pages/Vial2Bag.aspx; pp. 1-3 (admitted prior art).

Article with picture of West Pharmaceutical Services' Vial2Bag Needleless System, [on-line]; ISIPS Newsletter, Oct. 26, 2007]; retrieved from Internet Feb. 16, 2010]; URL:<http://www.isips.org/reports/ISIPS_Newsletter October_26_2007. html.> (7 pages. see pp. 5-6).

West, Vial2Bag DC system, Oct. 2, 2014, https://web.archive.org/web/20141002065133/http://www.westpharma.com/en/products/Pages/Reconstitutionsystems.aspx.

Youtube.com, Vial2Bag DC, Aug. 21, 2014, https://www.youtube.com/watch?v=FEOkg1xNBrs.

Vial-Mate Adapter Device, Baxter, May 2017, downloaded from web page:http://www.baxtermedicationdeliveryproducts.com/drug-delivery/vialmate.html, Download Date: Jul. 28, 2017, original posting date: unknown, 1page.

Int'l Preliminary Report on Patentability dated Feb. 12, 2016 in Int'l Application No. PCT/IL2016/050002.

Written Opinion dated Apr. 20, 2016 in Int'l Application No. PCT/IL2016/050002.

Int'l Search Report dated Apr. 20, 2016 in Int'l Application No. PCT/IL2016/050002.

* cited by examiner

DUAL VIAL ADAPTER ASSEMBLAGES WITH QUICK RELEASE DRUG VIAL ADAPTER FOR ENSURING CORRECT USAGE

CROSS-REFERENCE TO RELATED APPLICATIONS

This application is a Section 371 of International Application No. PCT/IL2016/050002, filed Jan. 3, 2016, which was published in the English language on Jul. 14, 2016, under International Publication No. WO 2016/110838 A1 and the disclosure of which is incorporated herein by reference.

BACKGROUND OF THE INVENTION

The invention relates to dual vial adapter assemblages for use with a drug vial containing a medicament and a liquid vial containing liquid contents for forming a liquid drug from the medicament in the drug vial.

Commonly owned U.S. Pat. No. 6,558,365 to Zinger et al. entitled Fluid Transfer Device discloses a dual vial adapter assemblage hereinafter referred to as the Zinger assemblage for use with a drug vial containing a medicament and a liquid vial containing liquid contents for forming a liquid drug from the medicament in the drug vial. The liquid contents can be diluent only or include an active component. The Zinger assemblage is commercially available from West Pharmaceutical Services, Inc., Exton, USA under the registered trademark MIX2VIAL. The Zinger assemblage includes a drug vial adapter for telescopic mounting on a drug vial and a liquid vial adapter for telescopic mounting on a liquid vial. The drug vial adapter has an integral drug vial stopper puncturing cannula for puncturing a drug vial stopper and a female connector in flow communication therewith. The liquid vial adapter has an integral liquid vial stopper puncturing cannula and a male connector in flow communication therewith. The female connector is preferably a Luer female connector and the male connector is preferably a Luer lock connector for an initial sealed releasable inter-engagement on the Luer female connector.

The Zinger assemblage is designed to be employed for use with a drug vial under negative pressure for drawing liquid contents from a liquid vial in an initial sealed inter-engagement of the drug vial adapter and the liquid vial adapter. Accordingly, the Zinger assemblage is necessarily initially telescopically mounted on a liquid vial and on inversion subsequently telescopically mounted on a negative pressure drug vial. Pursuant to forming a liquid drug in the drug vial and detachment of the liquid vial adapter from the drug vial adapter, the entire liquid drug contents are typically completely aspirated into an initially empty needleless syringe for administration purposes.

Commonly owned U.S. Pat. No. 8,752,598 to Denenburg et al. entitled Liquid Drug Transfer Assembly discloses a dual vial adapter assemblage hereinafter referred to as the Denenburg assemblage. The Denenburg assemblage is similar in construction and operation as the Zinger assemblage but is designed to be used for larger liquid drug volumes. U.S. Pat. No. 8,752,598 FIGS. 7 to 9 show the Denenburg assemblage includes a liquid vial adapter with an integral dual lumen dual ended spike having a liquid vial stopper puncturing cannula and a drug vial stopper puncturing cannula oppositely directed to its liquid vial stopper puncturing cannula and a drug vial stopper puncturing cannula oppositely directed to its liquid vial stopper puncturing cannula. Also, the drug vial adapter includes a female connector and an oppositely directed drug vial adapter sleeve in flow communication therewith. The Denenburg assemblage employs gravitational flow from a liquid vial to a drug vial and therefore requires an initial telescopic mounting on a drug vial and a subsequent telescopic mounting on a liquid vial to avoid spillage from the liquid vial. U.S. Pat. No. 8,752,598 FIGS. 10A to 10G show the use of the Denenburg assemblage for forming liquid drug contents sufficient for aspiration of several liquid drug dosages for staggered administration to a patient.

Both the Zinger assemblage and particularly the Denenburg assemblage because of its intended use for forming larger liquid drug volumes can be optionally employed for an administration protocol to a patient including: First, initial aspiration of some liquid drug contents from a drug vial to an initially empty needleless syringe for immediate administration to a patient, thereby leaving a liquid drug remainder in the drug vial. And second, subsequent administration of the liquid drug remainder by removal of the drug vial adapter from the drug vial to expose its drug vial stopper and forced insertion of an infusion set's IV spike through the drug vial stopper for prolonged gravitational infusion flow to the patient. However, detachment of a drug vial adapter from a drug vial is dexterously difficult particularly in the case a drug vial adapter is telescopically snap fit mounted on a drug vial and a healthcare provider typically has gloved hands. Moreover, a healthcare giver may inadvertently detach a liquid vial adapter from a drug vial adapter before initial aspiration of some liquid drug contents in contradistinction to the administration protocol.

BRIEF SUMMARY OF THE INVENTION

The present invention is directed towards dual vial adapter assemblages similar to hitherto described Zinger assemblage and Denenburg assemblage, and provides a dual vial adaptor assemblage as defined in claim 1. The dual vial adapter assemblages include a quick release drug vial adapter with a snap fit flex member pair for telescopic snap fit mounting on a drug vial and an upright finger grip extension pair oppositely extending to their snap fit flex member pair for manually urging inwards towards one another for outwardly flexing their snap fit flex member pair for releasing the quick release drug vial adapter from a drug vial. The inward flexing of the upright finger grip extension pair is precluded in an initial sealed inter-engagement of a liquid vial adapter and a quick release drug vial adapter such that a healthcare provider is unable to detach a drug vial adapter from the drug vial it is telescopically snap fit mounted thereon until detachment of the liquid vial adapter. Accordingly, the quick release drug vial adapter ensures correct usage of a dual vial adapter assemblage by preventing immediate removal of a drug vial adapter from a drug vial after forming liquid drug contents therein, thereby assisting a healthcare provider to follow an administration protocol requiring an initial aspiration of some liquid drug for immediate administration to a patient to leave a liquid drug remainder for subsequent infusion to the patient.

Dual vial adapter assemblages of the present invention can be implemented as follows: First, similar to hitherto mentioned U.S. Pat. No. 8,752,598 to Denenburg et al. Second, similar to U.S. Pat. No. 6,558,365 to Zinger et al. And third, similar to U.S. Pat. No. 6,558,365 to Zinger et al. but with a drug vial adapter having an integral dual lumen drug vial stopper puncturing cannula and a liquid vial adapter having an integral dual lumen liquid vial stopper puncturing cannula in initial flow communication with the integral dual lumen drug vial stopper puncturing cannula for enabling initial gravitational flow of liquid contents from a liquid vial to a drug vial.

BRIEF DESCRIPTION OF THE SEVERAL VIEWS OF THE DRAWINGS

In order to understand the invention and to see how it can be carried out in practice, preferred embodiments will now be described, by way of non-limiting examples only, with reference to the accompanying drawings in which similar parts are likewise numbered, and in which.

In the drawings.

DETAILED DESCRIPTION OF THE INVENTION

Figure 1:
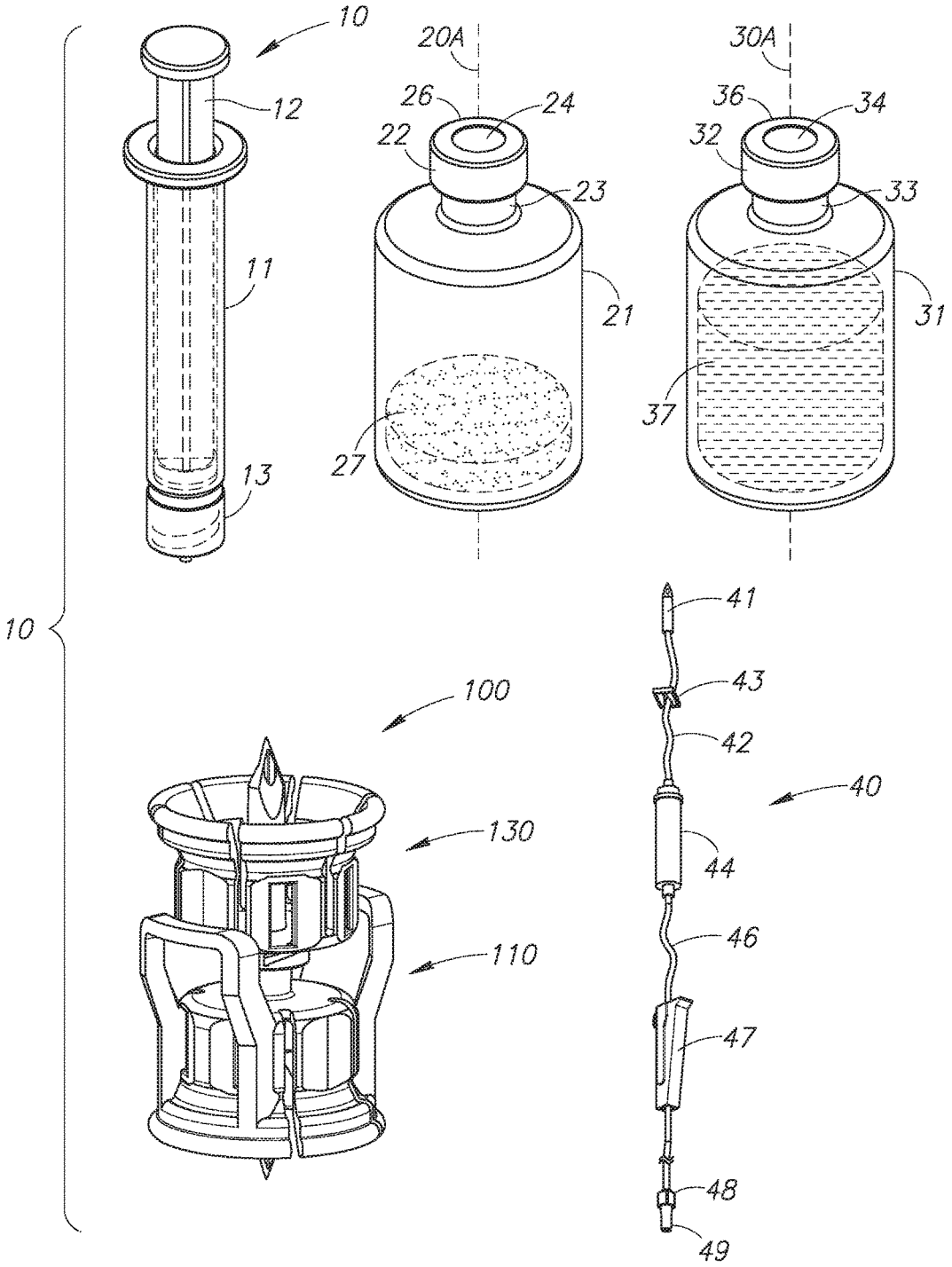
FIG. 1 is a pictorial view of an administration set including a needleless syringe, a drug vial, a liquid vial, an infusion set and a first embodiment of a dual vial adapter assemblage in accordance with the present invention.
Figure 2:
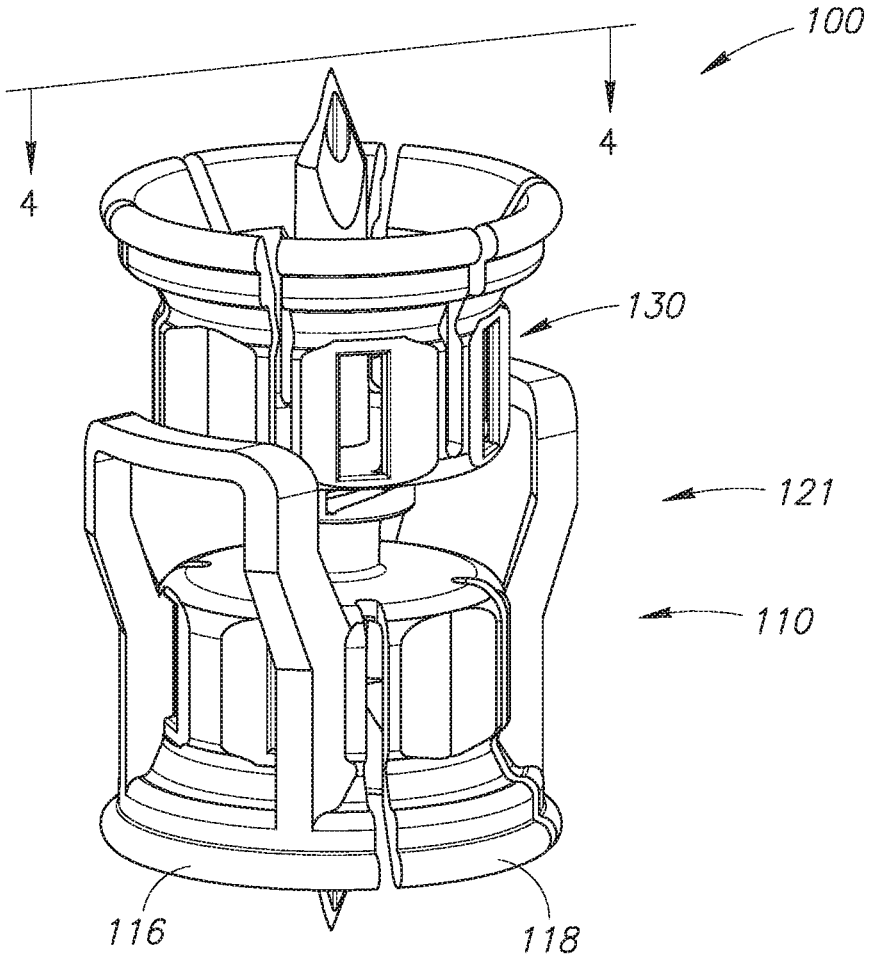
FIG. 2 is a perspective view of the FIG. 1 dual vial adapter assemblage including a quick release drug vial adapter.
Figure 3:
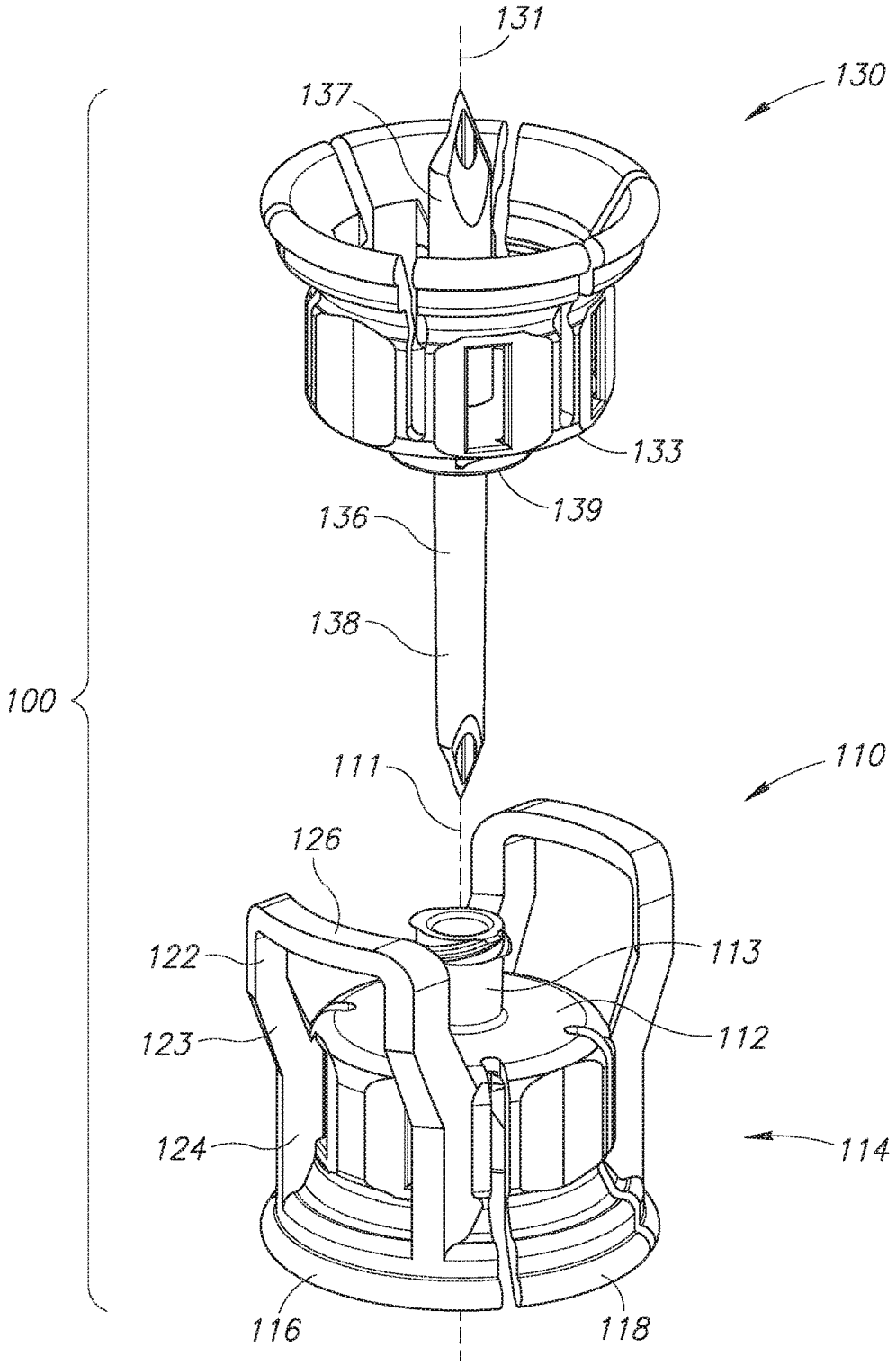
FIG. 3 is a perspective view of a dissembled FIG. 1 dual vial adapter assemblage.
Figure 4:
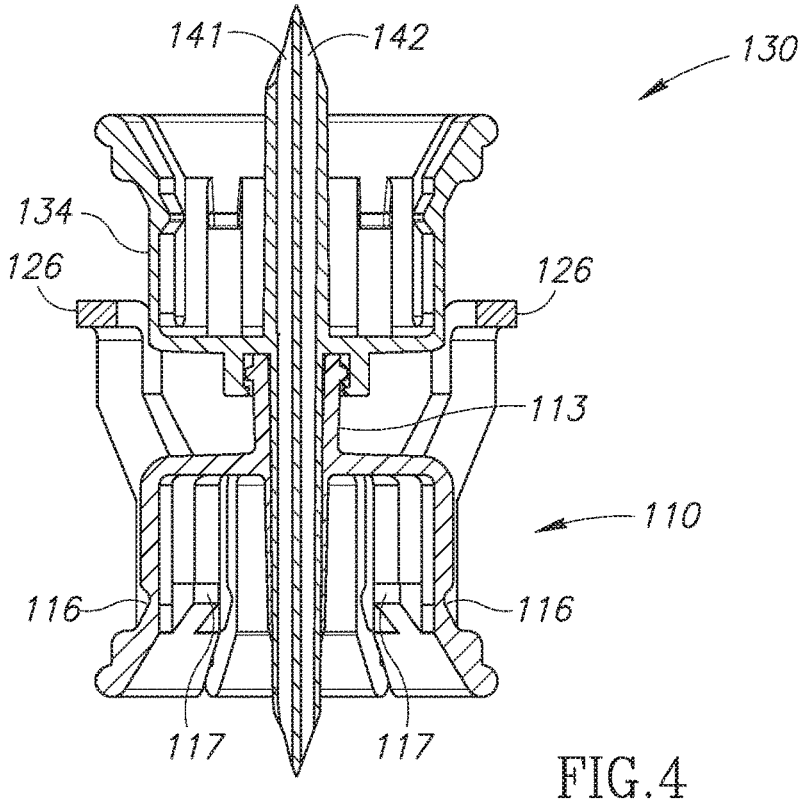
FIG. 4 is a longitudinal cross section of the FIG. 1 dual vial adapter assemblage along line 4-4 in FIG. 2.
Figure 5:
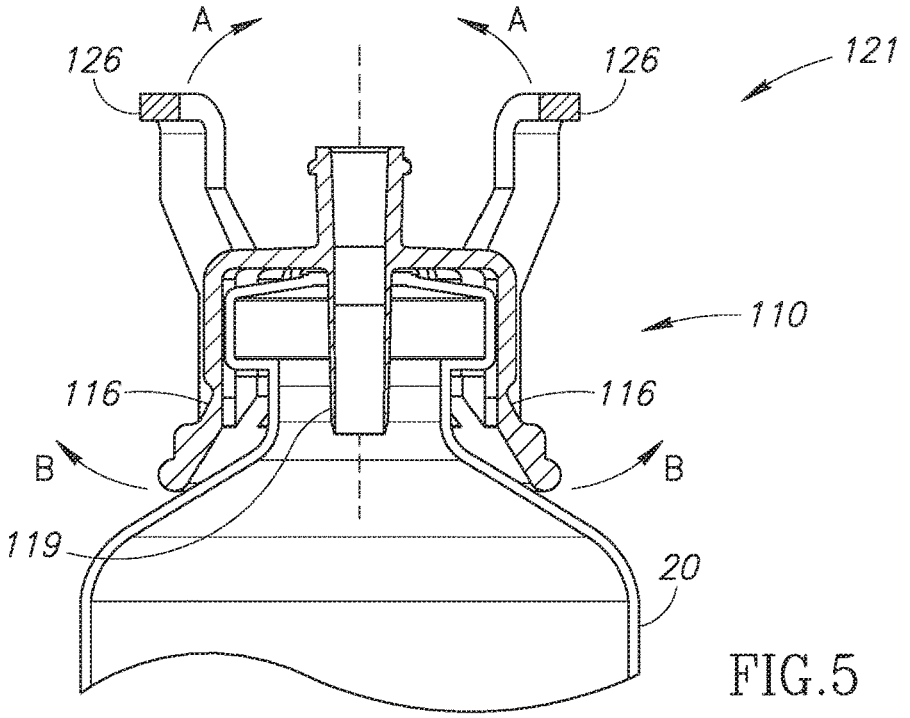
FIG. 5 is a perspective view showing manual operation of the FIG. 2 quick release drug vial adapter.

FIG. 1 shows an administration set 10 including an initially empty needleless syringe 10, a drug vial 20, a liquid vial 30, and an infusion set 40, and a dual vial adapter assemblage 100. The needleless syringe 10 includes a barrel 11 with a plunger 12 and a male Luer lock connector 13. The syringe 10 can be formed with other types of male connectors. The drug vial 20 has a longitudinal drug vial axis 20A and includes an open topped drug vial bottle 21 having a drug vial rim 22 and a narrow diameter drug vial neck 23. The drug vial 20 is sealed by a drug vial stopper 24. The drug vial stopper 24 is capped by a typically aluminum seal 26. The drug vial 20 includes a medicament 27 in the form of a powder, solid or liquid. The liquid vial 30 has a longitudinal liquid vial axis 30A and includes an open topped liquid vial bottle 31 having a liquid vial rim 32 and a narrow diameter liquid vial neck 33. The drug vial 30 is sealed by a liquid vial stopper 34. The liquid vial stopper 34 is capped by a typically aluminum seal 36. The liquid vial 30 includes liquid contents 37 in the form of diluent only or an active component. The infusion set 40 includes an IV spike 41, first tubing 42, a clamp 43, a drip chamber 44, second tubing 46, a roller clamp 47, a male Luer connector 48, and a Luer shield 49.

The dual vial adapter assemblage 100 includes a quick release drug vial adapter 110 and a liquid vial adapter 130 in initial sealed releasable inter-engagement. The drug vial adapter 110 has a longitudinal drug vial adapter centerline 111 and a transverse drug vial adapter top wall 112 with an upright female connector 113 and an opposite downward depending drug vial adapter skirt 114 for telescopic snap fit mounting on the drug vial 20. The upright female connector 113 can be a female Luer connector, and the like. The downward depending drug vial adapter skirt 114 includes an opposite snap fit flex member pair 116 resiliently pivotal at their juncture with the drug vial adapter top wall 112. The snap fit flex member pair 116 is formed with an inward directed protrusion pair 117 for snap fit under the drug vial rim 22 on telescopic snap fit mounting the drug vial adapter 110 on the drug vial 20. The downward depending drug vial adapter skirt 114 includes an additional opposite flex member pair 118 primarily employed for guidance purposes during the telescopic snap fit mounting and therefore formed with minor or without any inward directed protrusions.

The drug vial adapter 110 has a downward depending sleeve 119 in flow communication with the upright female connector 113 and oppositely directed thereto. The drug vial adapter 110 has a manually operable quick release arrangement 121 for selectively releasing the drug vial adapter skirt 114 from the drug vial 20, thereby exposing the drug vial stopper 24.

The liquid vial adapter 130 has a longitudinal liquid vial adapter centerline 131 co-axial with the longitudinal drug vial adapter centerline 111 on its initial sealed releasable inter-engagement with the drug vial adapter 110. The liquid vial adapter 130 includes a transverse liquid vial adapter top wall 133 and a liquid vial adapter skirt 134 for telescopic snap fit mounting on the liquid vial 30. The liquid vial adapter skirt 134 can optionally telescopically mount on the liquid vial 30 without snap fit.

The liquid vial adapter 130 includes a dual ended dual lumen spike 136 including a liquid vial stopper puncturing cannula 137 for puncturing the liquid vial stopper 34 on telescopic snap mounting the liquid vial adapter 130 on the liquid vial 30 and a drug vial stopper puncturing cannula 138 oppositely directed to the liquid vial stopper puncturing cannula 137 along the longitudinal liquid vial adapter centerline 131 for puncturing the drug vial stopper 24 on mounting the drug vial adapter 110 on the drug vial 20 in the assembled state of the dual vial adapter assemblage 100. The drug vial stopper puncturing cannula 138 is encircled by the downward depending sleeve 119 in the initial sealed releasable inter-engagement of the drug vial adapter 110 and the liquid vial adapter 130. The liquid vial adapter 130 includes a male lock connector 139 for releasable engaging the female connector 113. The male lock connector 139 is preferably a male Luer lock. The dual ended dual lumen spike 136 includes a liquid transfer lumen 141 and an air transfer lumen 142.

The quick release arrangement 121 is constituted by a pair of opposite upright finger grip extensions 122 oppositely extending to the snap fit flex member pair 116 relative to the drug vial adapter top surface 112. The finger grip extensions 122 are in the form of an inverted U-shape frame 123 each including a pair of opposite upright leg members 124 and a cross member 126 extending therebetween. The U-shape frame 123 reduces the manual force required to be applied to inwardly urge the finger grip extensions 122 toward one another. In the disassembled state of the dual vial adapter assemblage 100, manual inward urging of the finger grip extensions 122 towards one another as denoted by arrow A pivots the snap fit flex member pair 116 at their juncture with the drug vial adapter top surface 112 to outwardly urge their inward directed protrusion pair 117 away from the longitudinal drug vial adapter centerline 111 as denoted by arrows B. Such outward urging is sufficient that at most only a minor force is required to release the drug vial 20 from the drug vial adapter skirt 114. Preferably the outward urging is sufficient to release the drug vial 20 from the drug vial adapter skirt 114. In the assembled state of the dual vial adapter assemblage 100, the cross members 126 face the liquid vial adapter skirt 134 and are sufficiently close thereto such that the liquid vial adapter skirt 134 prevents manual inward urging of the finger grip extensions 122 toward one another to pivot the snap fit flex member pair 116.

Figure 6A:
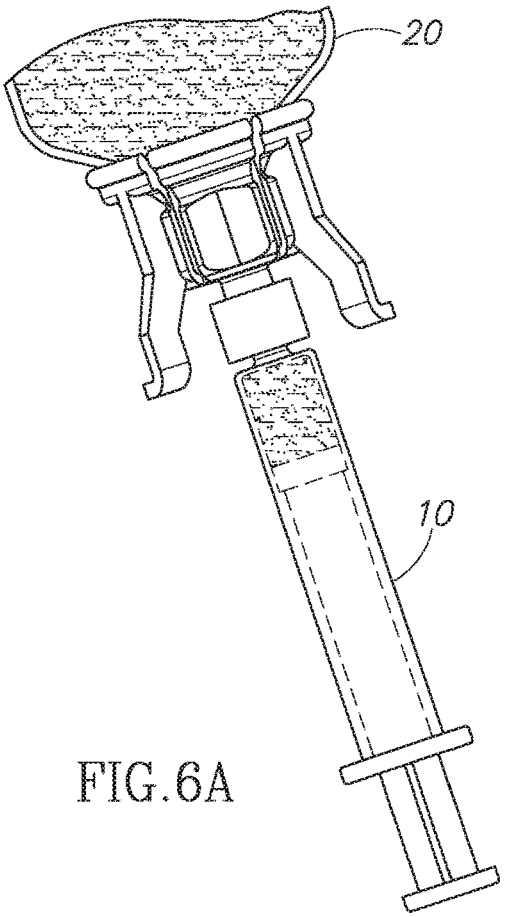
FIGS. 6A to 6C show use of the FIG. 1 dual vial adapter assemblage for administration of a liquid drug contained in a drug vial.
Figure 6B:
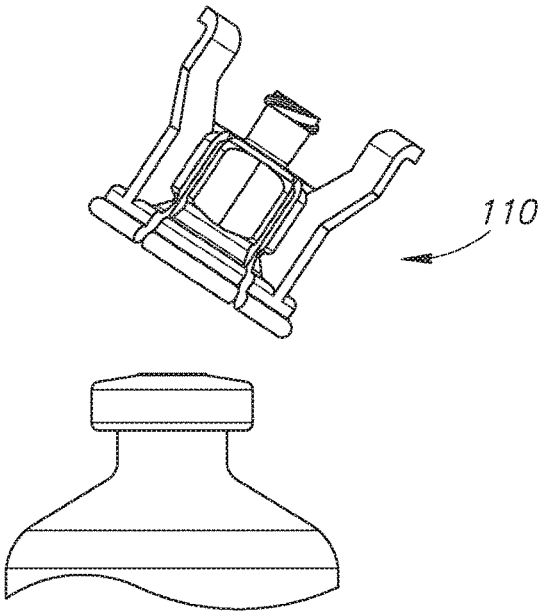
Figure 6C:
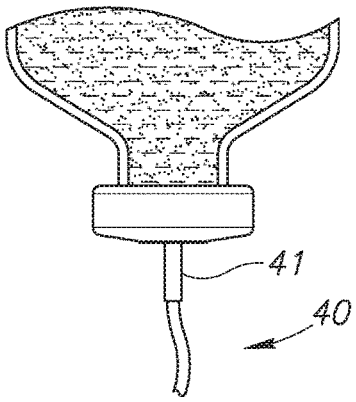

The use of the dual vial adapter assemblage 100 is the same as the aforementioned U.S. Pat. No. 8,752,598 FIGS. 10A to 10G for preparing liquid drug contents in the drug vial 20, detaching the liquid vial adapter 130 from the drug vial adapter 110 and attaching the needleless syringe 10 for aspirating some liquid drug for administration purposes to leave a liquid drug remainder in the drug vial (see FIG. 6A). Use of the dual vial adapter assemblage 100 additionally includes the step of manual operation of the quick release arrangement 121 to facilitate detaching the drug vial adapter 110 from the drug vial 20 to expose its drug vial stopper 24 (see FIG. 6B) and insertion of an infusion set's IV spike 41 through the drug vial stopper 24 for gravitational infusion of the liquid drug remainder to a patient (see FIG. 6C).

Figure 7:
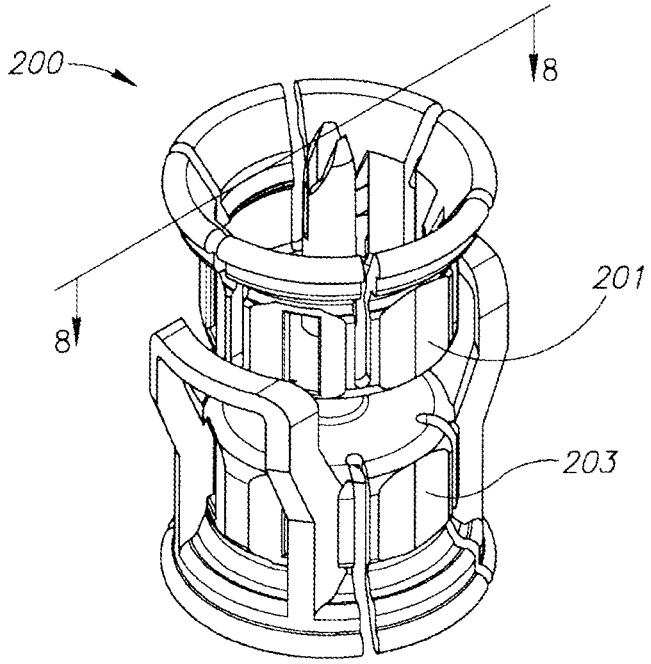
FIG. 7 is a perspective view of a second embodiment of a dual vial adapter assemblage including a quick release drug vial adapter in accordance with the present invention.
Figure 8:
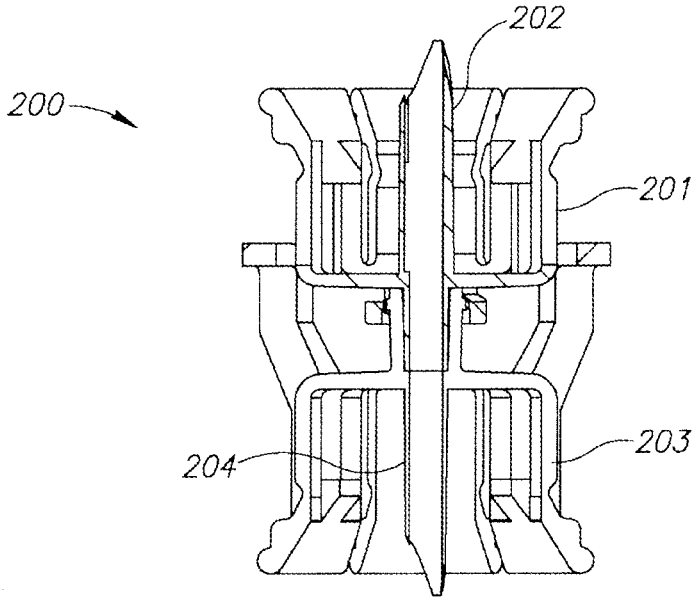
FIG. 8 is a longitudinal cross section of the FIG. 7 dual vial adapter assemblage along line 8-8 in FIG. 7.
Figure 9:
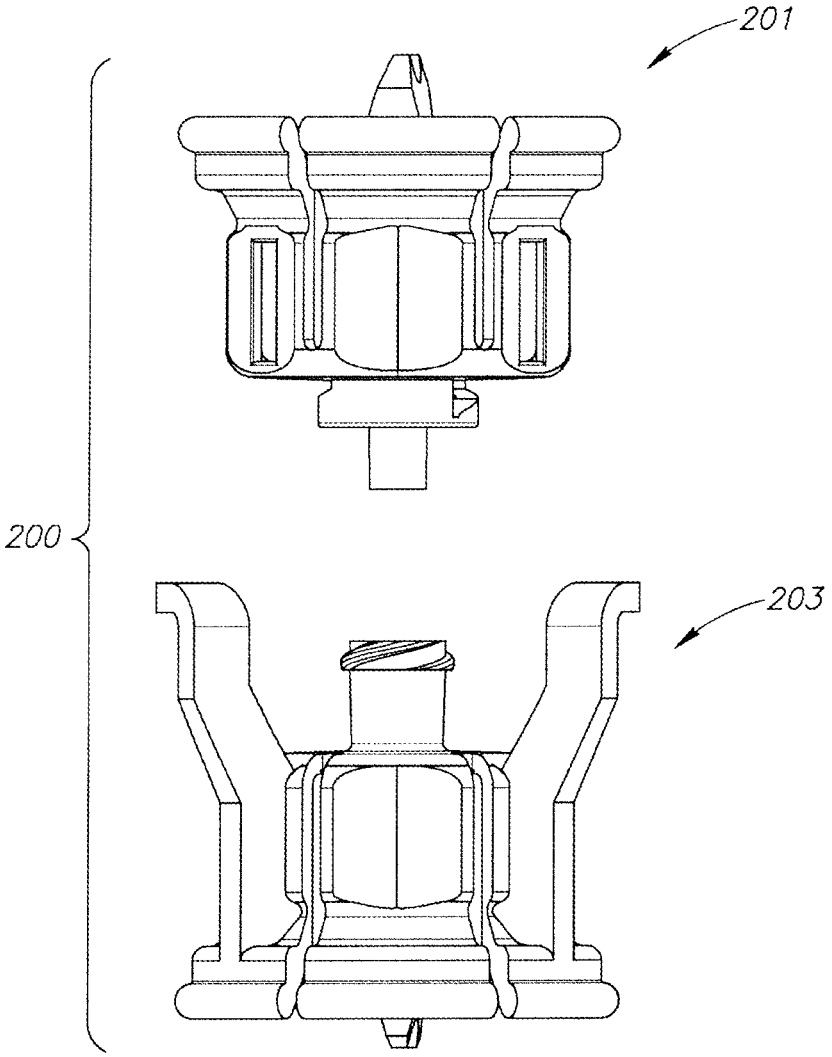
FIG. 9 is a dissembled view of the FIG. 7 dual vial adapter assemblage.

FIGS. 7 to 9 show a dual vial adapter assemblage 200 similar in construction and operation as the hitherto described U.S. Pat. No. 6,558,365 to Zinger et al. Accordingly, the dual vial adapter assemblage 200 includes a liquid vial adapter 201 having an integral single lumen liquid vial stopper puncturing cannula 202 and a quick release drug vial adapter 203 having an integral single lumen drug vial stopper puncturing cannula 204 in flow communication with the liquid vial stopper puncturing cannula 202.

Figure 10:
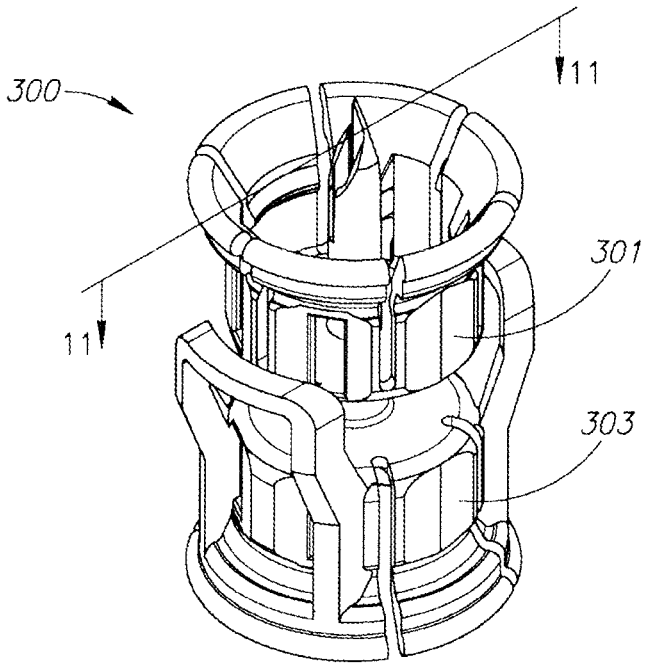
FIG. 10 is a perspective view of a third embodiment of a dual vial adapter assemblage including a quick release drug vial adapter in accordance with the present invention.
Figure 11:
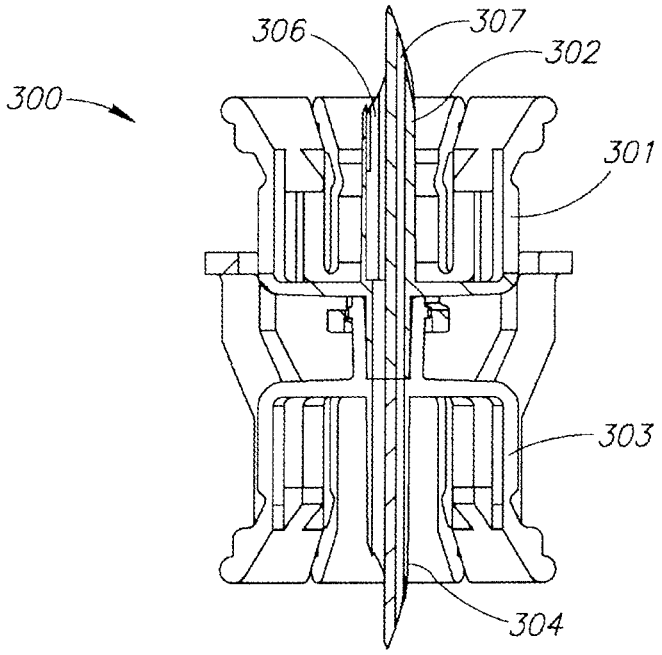
FIG. 11 is a longitudinal cross section of the FIG. 10 dual vial adapter assemblage along line 11-11 in FIG. 10.
Figure 12:
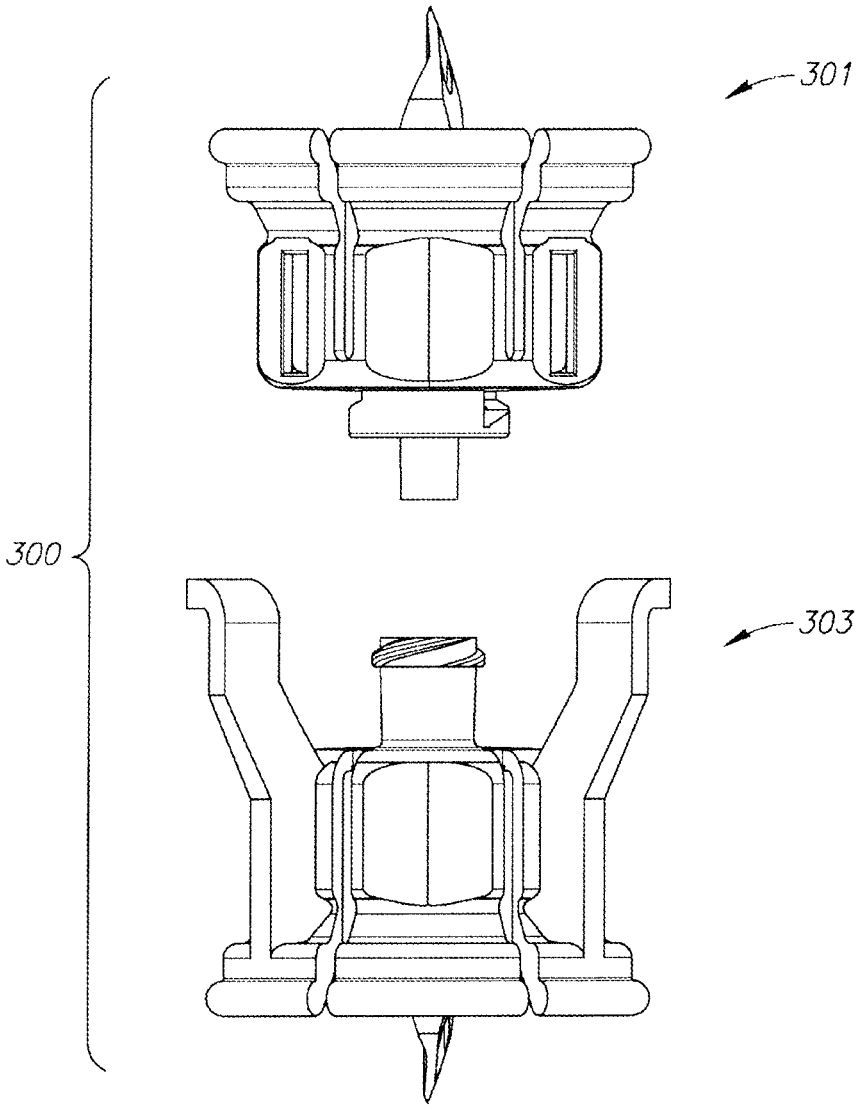
FIG. 12 is a dissembled view of the FIG. 10 dual vial adapter assemblage.

FIGS. 10 to 12 show a dual vial adapter assemblage 300 similar in construction and operation as the hitherto described U.S. Pat. No. 6,558,365 to Zinger et al. The dual vial adapter assemblage 300 includes a liquid vial adapter 301 having an integral dual lumen liquid vial stopper puncturing cannula 302 and a quick release drug vial adapter 303 having an integral dual lumen drug vial stopper puncturing cannula 304 in aligned flow communication with the liquid vial stopper puncturing cannula 302 to form an air transfer lumen 307 and a parallel liquid transfer lumen 306.

While particular embodiments of the present invention are illustrated and described, it would be obvious to those skilled in the art that various other changes and modifications can be made without departing from the spirit and scope of the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A dual vial adapter assemblage for use with a drug vial and a liquid vial, the drug vial having a drug vial bottle and a drug vial stopper sealing the drug vial bottle containing a medicament, the liquid vial having a liquid vial bottle and a liquid vial stopper sealing the liquid vial bottle containing liquid contents for forming a liquid drug from the medicament in the drug vial, the dual vial adapter assemblage comprising:

(a) a drug vial adapter having a longitudinal drug vial adapter centerline and including a transverse drug vial adapter top wall with an upright female connector and an opposite downward depending drug vial adapter skirt with a snap fit flex member pair resiliently flexible at said transverse drug vial adapter top wall and having an inward directed protrusion pair for telescopic snap fit mounting on the drug vial;

(b) a liquid vial adapter having a longitudinal liquid vial adapter centerline co-axial with said longitudinal drug vial adapter centerline on an initial sealed releasable inter-engagement with said drug vial adapter, said liquid vial adapter including a transverse liquid vial adapter top wall, a liquid vial adapter skirt for telescopic mounting on the liquid vial and a liquid vial stopper puncturing cannula for puncturing the liquid vial stopper on said telescopic mounting said liquid vial adapter on the liquid vial; and (c) a drug vial stopper puncturing cannula for puncturing the drug vial stopper on said telescopic snap fit mounting said drug vial adapter on the drug vial, said drug vial stopper puncturing cannula being in flow communication with said liquid vial stopper puncturing cannula in said initial sealed releasable inter-engagement of said liquid vial adapter and said drug vial adapter, characterized in that said drug vial adapter is a quick release drug vial adapter further including an upright finger grip extension pair oppositely extending to said snap fit flex member pair for manual inward urging towards one another for selectively pivoting said snap fit flex member pair at said transverse drug vial adapter top wall for outwardly urging their said inward directed protrusion pair away from said longitudinal drug vial adapter centerline for facilitating release of said drug vial adapter from the drug vial thereby exposing the drug vial stopper, said upright finger grip extension pair facing said liquid vial adapter skirt in said initial sealed releasable inter-engagement of said liquid vial adapter and said drug vial adapter and being sufficiently close to said liquid vial adapter skirt such that said liquid vial adapter skirt prevents said manual inward urging of said upright finger grip extension pair towards one another to release said drug vial adapter from the drug vial.

2. The assemblage according to claim 1 wherein said liquid vial adapter includes a dual ended dual lumen spike having said liquid vial stopper puncturing cannula and said drug vial stopper puncturing cannula.

3. The assemblage according to claim 1 wherein said liquid vial adapter includes an integral liquid vial stopper puncturing cannula and said drug vial adapter includes an integral drug vial stopper puncturing cannula.

* * * * *